US005114052A

United States Patent [19]

Tiramani et al.

[11] Patent Number: 5,114,052

[45] Date of Patent: May 19, 1992

[54] MANUALLY ACTUATED TRIGGER SPRAYER

[75] Inventors: Paolo M. B. Tiramani, New York, N.Y.; Thomas C. Van Dyk, Prospect Park, N.J.

[73] Assignee: Goody Products, Inc., Kearny, N.J.

[21] Appl. No.: 780,824

[22] Filed: Oct. 23, 1991

Related U.S. Application Data

[63] Continuation of Ser. No. 441,067, Nov. 22, 1989, abandoned, which is a continuation-in-part of Ser. No. 236,592, Aug. 25, 1988, Pat. No. 4,898,307.

[51] Int. Cl.[5] ..... B65D 37/00; B67D 5/40

[52] U.S. Cl. ..... 222/207; 222/380; 222/383; 239/333; 239/493

[58] Field of Search ..... 222/207, 209, 210, 211, 222/214, 323, 324, 340, 339, 379, 380, 382, 383, 490, 491; 239/333, 485, 493, 494, 496

[56] References Cited

U.S. PATENT DOCUMENTS

| | | | |
|---|---|---|---|
| 2,772,116 | 11/1956 | Dobkin | 222/383 |
| 3,843,030 | 11/1974 | Micallef | 222/554 |
| 3,973,700 | 8/1976 | Schmidt et al. | 222/153 |
| 4,088,248 | 5/1978 | Blake | 222/207 |
| 4,120,429 | 10/1978 | Vignot | 222/207 |
| 4,182,465 | 1/1980 | Bennett | 222/207 |
| 4,201,317 | 5/1980 | Aleff | 222/207 |
| 4,227,650 | 10/1980 | McKinney | 222/380 |
| 4,230,277 | 10/1980 | Tada | 239/333 |
| 4,241,854 | 12/1980 | Bennett et al. | 222/211 |
| 4,260,079 | 4/1981 | Cary et al. | 222/209 |
| 4,596,344 | 6/1986 | Corsette | 222/340 |
| 4,624,413 | 11/1986 | Corsette | 239/333 |
| 4,691,849 | 9/1987 | Tada | 222/382 |
| 4,732,549 | 3/1988 | Schuckmann | 417/472 |
| 4,858,788 | 8/1989 | Meckenstock | 222/207 |

FOREIGN PATENT DOCUMENTS

| | | | |
|---|---|---|---|
| WO82/02372 | 7/1982 | PCT Int'l Appl. | 222/207 |

*Primary Examiner*—Kevin P. Shaver

[57] ABSTRACT

A dispensing device for the discharge of liquids, particularly for the spraying of the liquids employs a trigger operated bellows acting as the pump chamber. A nozzle carries the valve body of a discharge check valve for the pump chamber. The intake check valve for the pump chamber is formed as a one piece component with the pump chamber for reducing the number of parts of the trigger sprayer.

17 Claims, 5 Drawing Sheets

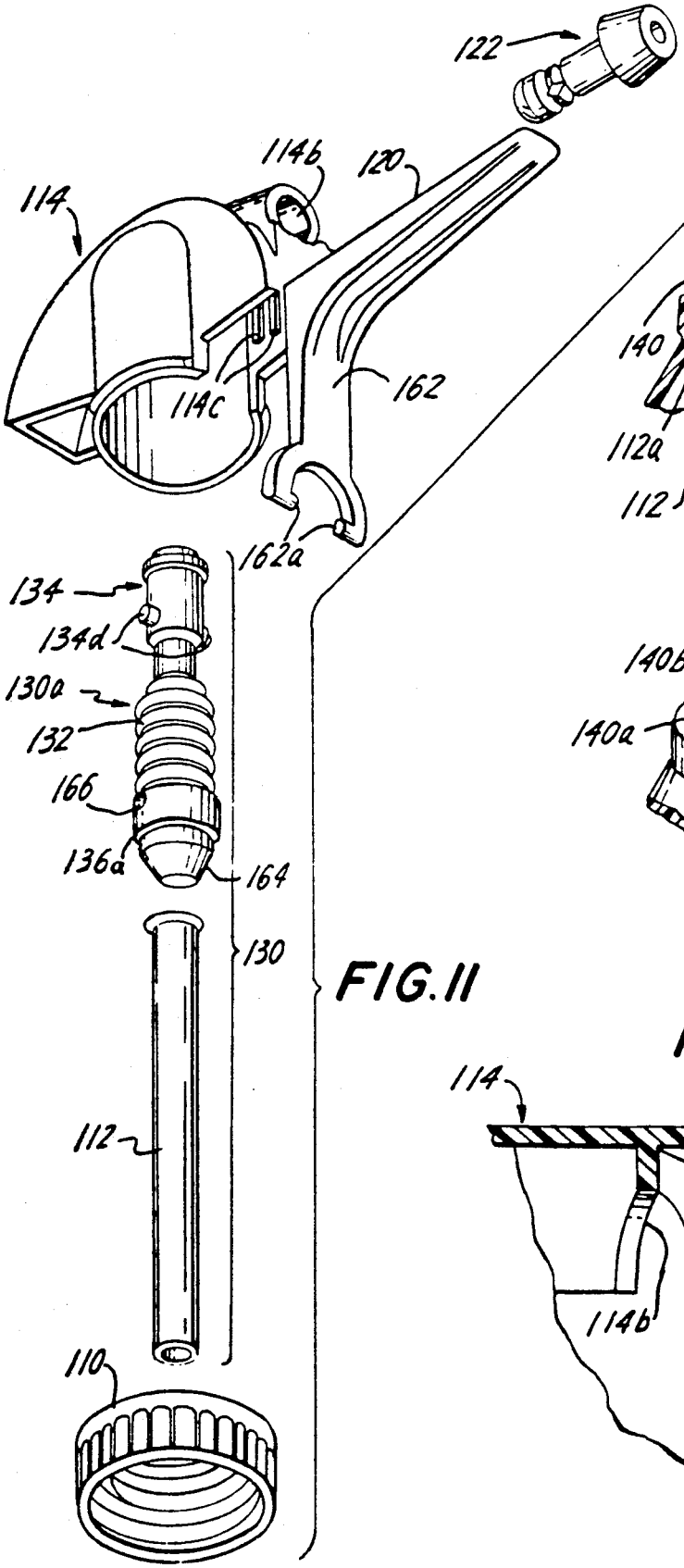
FIG.11
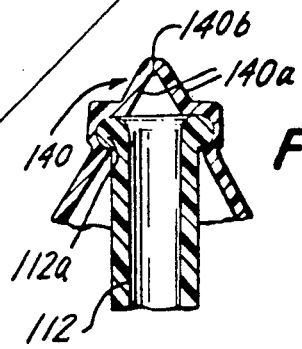
FIG.12
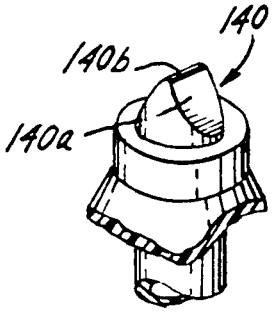
FIG.13
FIG.14
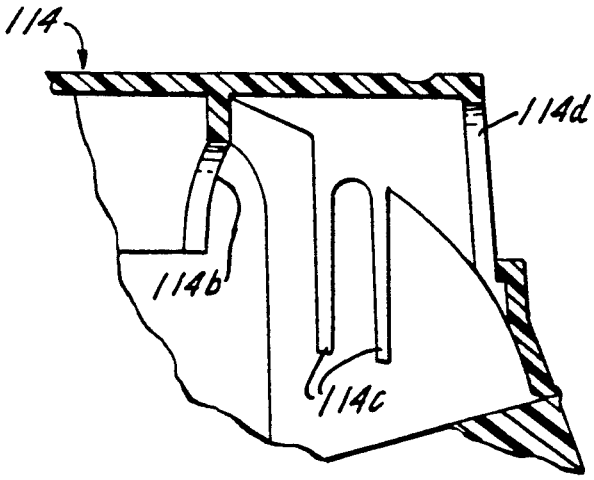

MANUALLY ACTUATED TRIGGER SPRAYER

This is a continuation of application Ser. No. 441,067 filed Nov. 22, 1989, now abandoned, which is a continuation-in-part of application Ser. No. 236,592 filed Aug. 25, 1988, now U.S. Pat. No. 4,898,307.

The present invention relates to what are commonly called "spray caps". A spray cap is attached to a container of liquid to dispense, bursts when a manual actuator.

Spray caps have long been known which meet some or all of a range of requirements. In one respect, a spray cap is to provide a spray discharge in one adjustment of its nozzle and to be positively shut off in another nozzle adjustment. As an additional alternative, the nozzle of some spray caps is adjustable to provide "stream" or "jet" bursts of discharge in addition to the shut-off and "spray" choices.

Nozzles of spray caps that are adjustable to varied settings may be leaky; and a variety of relatively complicated forms of construction have been proposed aimed at preventing such leakage.

Still further, it has long been known that air should be admitted to the liquid supply container to replace the volume of liquid that is discharged progressively, to avoid developing vacuum in the container, such as would impair or disable the spray cap; and it has been proposed that the vent passage that avoids the vacuum should be shut when the spray cap is not in use (as during shipment) to avoid leakage by way of said vent passage.

Spray caps meeting these requirements have been available but they tend to be complicated, and their cost in parts and the expense of assembly tend to be high.

The present invention provides spray caps that are distinctively novel in several respects. Their construction is vastly simpler, uses fewer parts and is easier to assemble than available spray caps capable of meeting all of the foregoing requirements.

In one respect, a novel nozzle-and-check valve structure is provided as one plastic molded part that cooperates with the outlet end of a discharge tube, providing shut-off, spray and jet modes of operation. In another respect, a leak-preventing mount for the adjustable nozzle of a spray cap is provided, without resort to the complications of O-rings that are usually found in such spray caps.

Still further, one novel spray cap is provided in which the entire liquid-containing portion that supplies liquid to the discharge nozzle is a single part. A dip tube and a bellows which constitutes a pump chamber, and a discharge tube are all combined into a continuous-wall unitary component that replaces many parts heretofore found in any single spray cap meeting the same combined requirements. In another novel spray cap, the liquid-containing tube and the bellows constitute a continuous-wall one-piece component, and the dip tube is made as a separate part that is joined to the one-piece component. In that way, a standardized bellows-and-discharge-tube component can be used with dip tubes of various lengths for use with various sizes of supply containers.

The nature of the invention and its novel aspects will be best understood and appreciated by reviewing the following detailed description of two novel spray caps that are shown in the accompanying drawings.

In the drawings:

FIG. 2 is an exploded perspective showing the components of the spray cap in FIG. 1, in their as-made conditions;

FIG. 11 is an exploded perspective view showing all of the parts of the spray cap of FIG. 8, the scale of the parts in FIG. 11 being reduced compared to FIG. 8;

FIG. 12 is an enlarged fragmentary cross-section of a portion of the spray cap of FIG. 8, the plane of FIG. 12 being perpendicular to the plane of FIG. 8;

FIG. 13 is a perspective view, partly in cross-section, of the structure shown in FIG. 12; and FIG. 14 is a fragmentary cross-section of a component in FIG. 8.

Figure 1:
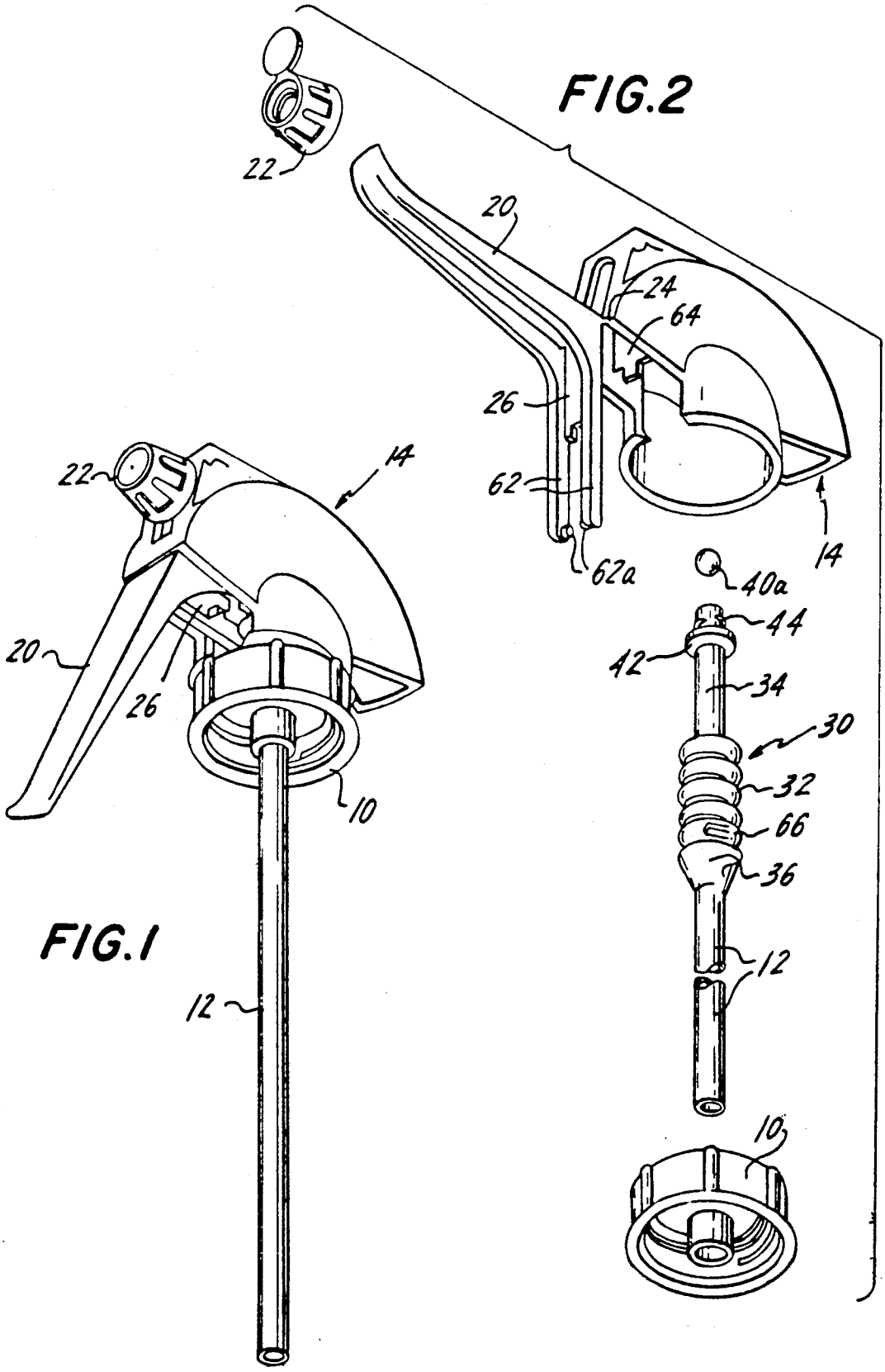
FIG. 1 is a perspective of a novel spray cap as an illustrative embodiment of the invention in its various aspects.

The illustrative spray cap in FIG. 1 includes a threaded closure 10 for a bottle or other container of liquid to be dispensed and a dip tube or intake tube 12 extending downward from closure 10. A main body 14 is mounted rotatably on closure 10, for example by means of a circular rib 16 (FIG. 4) extending radially inward at the lower edge of main body 10. This rib is received in circular groove 18 around closure 10. The spray cap further includes a finger-operated trigger or lever 20 hinged to body 14, and a nozzle 22 on body 14. Trigger 20 and main body 14 in this spray cap are molded of a suitable plastic as a single unit connected by a thinned portion or "living hinge" 24 of the molded unit. A leaf spring 26 (FIGS. 1–4) is an integral portion of the molded plastic trigger, thus being a portion of the molded unit.

Figure 3:
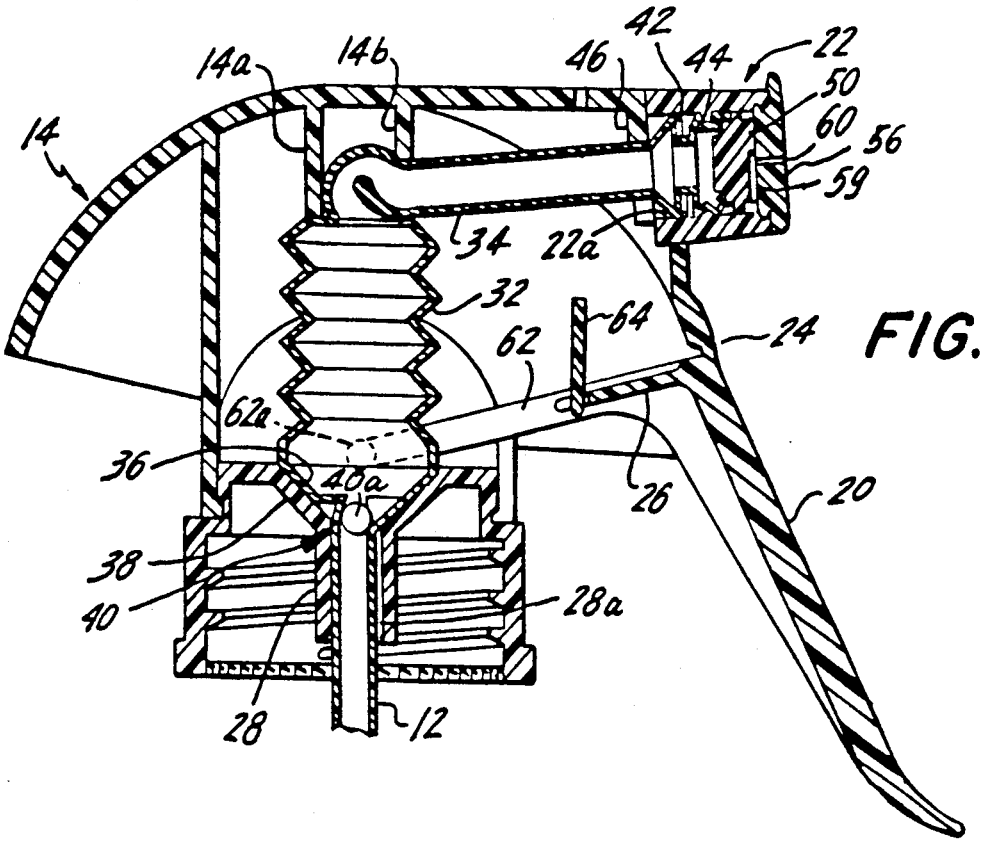
FIG. 3 is an enlarged cross-section of the spray cap of FIG. 1, the nozzle being tightened to provide a positive shut-off in that region and with the trigger in its extended at-rest or released position.
Figure 4:
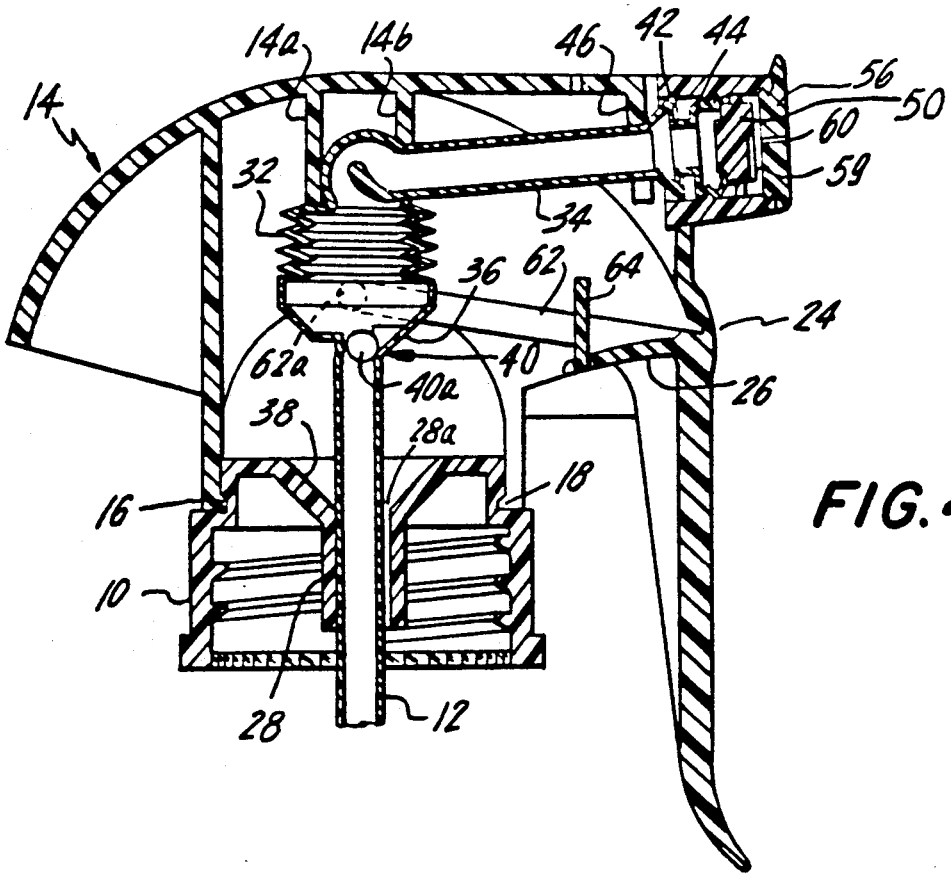
FIG. 4 is a cross-section like FIG. 3 with the nozzle set for discharging liquid and the trigger stroke being complete.

Further details of the spray cap are shown in FIGS. 3 and 4. Dip tube 12 has a sliding and rotary fit in a tubular portion 28 of closure 10; a venting passage **28*a* is formed by a groove extending from end-to-end of portion 28** along its inner surface.

Component 30 is a single part that may be produced in an injection blow-molding machine. Unit 30 comprises dip tube 12, bellows 32 and discharge tube 34 extending in a straight line as shown in FIG. 2. As seen in FIGS. 2–4, the cross-section of the bellows is large compared with that of the dip tube 12 and the discharge tube 34; there are passage-constricting transitions at the opposite ends of bellows 32, between the opposite ends of the bellows and the intake and discharge tubes 12 and 34, respectively. Component 30 may be molded of various materials, provided that bellows 32 is resilient (not merely yielding). For example, component 30 may be made of selected grades of polyethylene, polypropylene, or polyvinyl chloride. Dip tube 12, bellows 32 and discharge tube 34 (with its head or discharge end portion, detailed below) constitute the entire liquid container of this spray cap except for nozzle 22; it constitutes a continuous-wall passage for the liquid.

The lower end of the bellows 32 is a projecting conical wall 36 that has a complementary fit in concave conical seat 38 at the upper end of tubular portion 28 of the closure 10. The juncture of dip tube 12 and conical wall 38 has formations for loosely retaining ball 40*a*. The upper end of dip tube 12 internally provides a circular valve seat for ball 40*a*. That valve seat and ball 40*a* constitute the inlet or intake check valve 40.

In FIGS. 2–4, the discharge end of discharge tube 34 includes an integral resilient thinned sealing flange 42 and a male thread 44. The outer diameter of flange 42 in the form shown is at least as large as the outer diameter of male threads 44. Main body 14 has a transverse wall 46 in which there is a slot that opens downward; and discharge tube 34 is received transversely in that slot, so that the formation that provides flange 42 is disposed against the surface of wall 46. Nozzle 22 is screwed onto the male thread 44 of component 30. Nozzle 22 has an internal cylindrical surface 22*a* (FIG. 6) against which flange 42 forms a seal. Main body 14 also includes two wall portions 14*a* and 14*b* which (FIGS. 3 and 4) coact with discharge tube 34 for securely locating that tube holding the formation of flange 42 securely against wall 46. These walls also establish the position of the upper end of bellows 32. In its extended condition represented in FIG. 3, bellows 32 is slightly compressed so that its conical end portion 36 is biased against valve seat 38.

Figure 5:
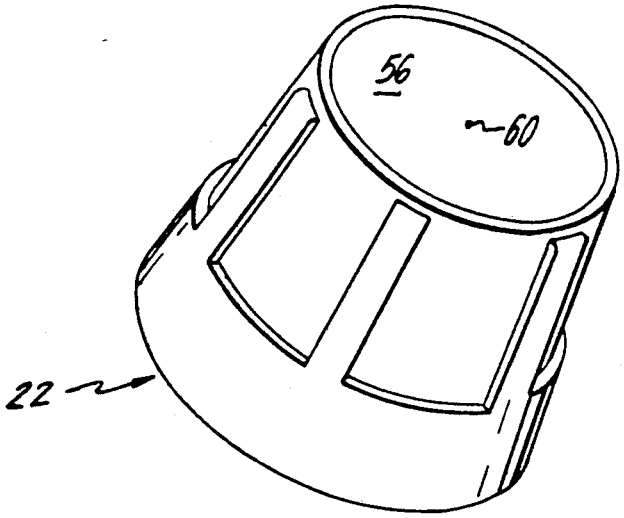
FIG. 5 is a greatly enlarged perspective view of the nozzle of the spray cap in FIG. 1.
Figure 6:
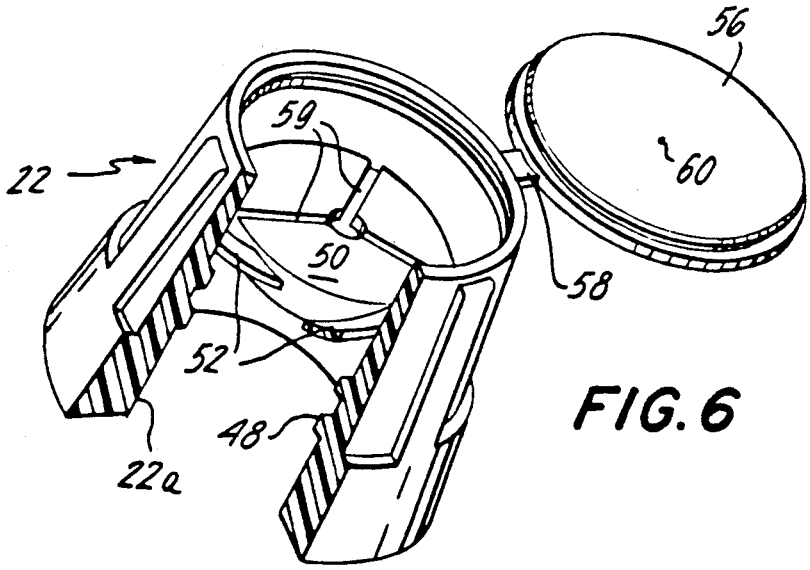
FIG. 6 is a perspective view, partly in cross-section, of the nozzle in its as-molded condition.
Figure 7:
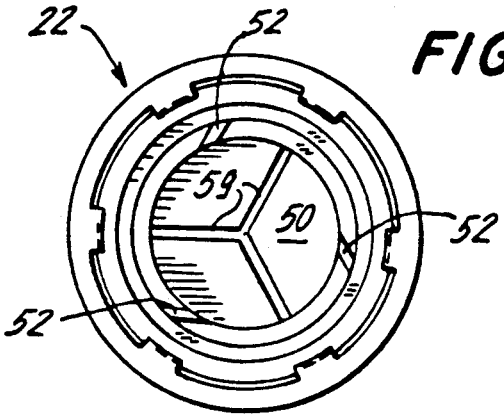
FIG. 7 is a right-hand end view of the nozzle of FIGS. 5 and 6 with its hinged cover removed.

Nozzle 22 is best shown in FIGS. 5–7. Internal or female threads 48 of the nozzle cooperate with male threads 44 of component 30. Valve body 50 is an integral portion of nozzle 22. Valve body 50 is supported by three arms 52 that extend homogeneously from both body 50 and the side wall of nozzle 22. The opposite ends of each arm 52 are displaced arcuately from each other. The arms accommodate bodily movement of member 50 along the nozzle's axis. Nozzle 22 includes a front wall 56 that is connected to the body of the nozzle by an integral hinge 58. Front wall 56 has an annular edge formation that interlocks in a leak-proof manner with a complementary annular formation in the body of the nozzle when its front or end wall is snapped into place, the completed state of the nozzle being represented in FIG. 5. The nozzle is of molded plastic. The advantage of hinging wall 56 to the rest of the nozzle is that the hinge provides automatic alignment of the front wall with the space that is to receive it. The front wall can be molded as a separate part if preferred. Nozzle 22 including its integral portions 50, 52 and 56 may be made of suitably resilient grades of polyethylene, polyvinyl-chloride or polypropylene, for example.

When nozzle 22 is threaded onto the head or discharge end of discharge tube 34 to the extent represented in FIG. 4 (there being a small clearance between nozzle 22 and wall 46) valve member 50 bears against the very end of tube 34. That end of tube 34 is shaped as a valve seat for valve member 50. Member 50 and its cooperating valve seat constitute a discharge check valve.

Arms 52 normally hold the discharge check valve closed in the adjustment of nozzle 22 as represented in FIG. 4. When liquid is forced into delivery tube 34 (see below) the liquid pressure lifts valve member 50 away from its valve seat and shifts member 50 toward the inner surface of end wall 56.

It may be considered that nozzle 22 is adjusted so that there is only a small clearance between end wall 56 of the nozzle and the surface of valve body 50 facing that end wall. Arms 52 press body 50 against its valve seat. Operation of trigger 20 develops pressure that lifts body 50 against wall 56. Liquid passes the circumferal edge of check valve body 50 and travels radially inward along slots 59 in body 50, and leaves the nozzle by way of a small orifice 60 through front wall 56. In this condition of the nozzle, a fine atomized spray results. This effect can be varied, as by shaping the grooves to swirl the liquid that enters the nozzle's orifice.

Nozzle 22 can be adjusted so that outlet or discharge check valve body 50 bears against its valve seat at rest—as shown in FIG. 4—but with end wall 56 spaced away from body 50 far enough so that, when trigger 20 is operated and liquid pressure lifts body 50 away from its valve seat, a clearance space still remains between body 50 and end wall 56. In that adjustment the liquid that crosses the circumferential edge of body 50 flows across the entire common area of body 50 and wall 56; and as a result, a jet or stream of liquid leaves the orifice.

Nozzle 22 can be screwed onto threads 44 far enough so that end wall 56 of the nozzle drives valve member 50 firmly against its seat (FIG. 3), providing a positive shut-off. This guards against leakage via the nozzle without depending on resilient bias to hold the outlet check valve closed, as when the spray cap is mounted on a container filled with liquid, and the container with the spray cap in place is to be shipped.

It was mentioned above that trigger 20 is connected to the main body 14 of the spray cap by a living hinge 24. FIG. 2 shows the condition of main body 14 and trigger 20 as that composite unit leaves a molding press. Trigger 20 projects to one side of main body 14. Integral leaf-spring portion 26 in FIG. 2 is flanked by two trigger arms 62 which have in-turned spaced-apart buttons 62*a*. The longitudinal edges of the leaf spring are separated slightly from arms 62, allowing the leaf spring to become deflected in operation. Main body 14 contains a stop 64 that is directed downward, extending from an upper mounting portion which is integral with opposite walls of main body 14. Stop member 64 is widest where it extends integrally from the opposite walls of main body 14. Much of the downward-extending part of stop member 64 is narrower, providing clearance spaces between the walls of main body 14 and the opposite long edges of that part of the stop. Arms 62 of the trigger are received in those clearance spaces.

The at-rest operative condition of main body 14 and trigger 20 is represented in FIG. 3. Trigger 20 extends downward, below passage portion 34 and nozzle 22 and opposite to but spaced from the common axis of dip tube 12 and bellows 32. Trigger 20 extends at a slight slant away from the lower portion of the spray cap. Integral leaf spring 26 of the trigger engages fixed stop 64 in the main body. The ends of spring 26 and stop 64, as shown in FIG. 2, have advantageously interlocking tongue-and-notch formations as assurance that their alignment and cooperation will be maintained. Arms 62 of the trigger (FIG. 3) are disposed at opposite sides of depending stop 64. Buttons 62*a* of the trigger are received under lifting shoulders 66 (FIG. 2) formed near the bottom of bellows 32 at the opposite sides of the bellows. Arms 62 of the trigger 20 sweep along opposite side edges of leaf spring 26 and along opposite side edges of stop 64 when the trigger is squeezed, ending in the position represented in FIG. 4.

The parts shown in FIG. 2 are quickly and easily assembled to form the spray cap of FIG. 1. First ball 40*a* is pressed into its detented position at the juncture of bellows 32 and dip tub 12. Then unit 30 is inserted into main body 14 in its position represented in FIG. 3. Component 30 is bent from its as-made condition (FIG. 2) to its final condition (FIGS. 1 and 4). Trigger 20 is swung into place 5 so that buttons 62*a* are received in groove formations 66 at the bottom of the bellows. Finally, the closure 10 is forced into assembly with main body 14, tubular portion 28 of the closure sliding along the dip tube in this step of assembly.

The operation of the spray cap is now restated. With nozzle 22 in its adjustment represented in FIG. 3, the nozzle is sealed against leakage. Its end wall 56 forces body 50 against the seat of the outlet or discharge check valve at the end of discharge tube 34. Vent passage 28*a* is sealed by the cooperation of complementary conical parts 36 and 38 of the bellows 32 and the closure 10.

When nozzle 22 is unscrewed somewhat to provide a small clearance between end wall 56 of the nozzle and the movable body 50 of the outlet check valve, body 50 at first remains biased against the outlet valve seat formed by the very end of the outlet tube 34. Squeezing trigger 20 from the position in FIG. 3 to that in FIG. 4 develops pressure that closes intake valve 40 and shifts member 50 against end wall 56 of the nozzle. Liquid is forced across the circumferal edge of body 50 and along channels 59, becoming a fine spray as the discharge leaves orifice 60.

Yet a further adjustment of nozzle 22 holds body 50 of the outlet or discharge check valve against its valve seat while trigger 20 remains extended, but a larger clearance space is established between body 50 and end wall 56 such that, with ordinary squeeze effort applied to the trigger, body 50 does not reach end wall 56. The liquid fills the clearance space between body 50 and wall 56 and leaves orifice 60 as a stream.

Each operation of the trigger produces a discharge burst, whether as a spray or as a stream. The extent that body 50 is lifted toward end wall 56 is adjusted by screwing the nozzle in or out; but the described modes of operation are realized by suitable design of arms 52 and choice of the material used in molding the nozzle.

After each discharge operation, trigger 20 is released and, due to the bias of its integral leaf spring 26, it returns to its starting position. Bellows 32 is operated by its resiliance to return to its extended position (FIG. 3). The outlet check valve becomes closed when the internal pressure drops. Therefore the negative pressure that develops in bellows 32, as it starts to become extended, opens the inlet check valve 40 and draws liquid up the dip tube to replace the discharged liquid.

The composite dip tube 12, pump-chamber bellows 32 and discharge tube 34 constitute a joint-free unit of plastic. That unit, with nozzle 22 and its check-valve body 50, represent virtually all of the spray-cap material that is exposed to the liquid to be dispensed. Ideally, ball 40*a* is of an inert material such as stainless steel. Accordingly, all of the material that is exposed to the contained liquid is—or can be—made immune to attack by or interaction with common liquids to be dispensed.

FIGS. 8-14 represent a second form of spray cap embodying aspects of the invention in common with the spray cap of FIGS. 1-7. The spray cap of FIGS. 8-14 embodies further aspects of the invention. Components in FIGS. 8-14 that are the same as, or a modification of, the components of FIGS. 1-7 bear numerals in the "100" series corresponding to the numerals in FIGS. 1-7. As is evident, much of the description and discussion of FIGS. 1-7 applies to FIGS. 8-14.

Threaded closure 110 is rotatably interlocked with body or housing 114 for securing the spray cap to a bottle or other container of a supply of liquid or equivalent material. A nozzle 122 abuts housing 114. Liquid passage means 130 could be of one piece, as in FIGS. 1-7. However, dip tube 112 is a separate piece in FIGS. 8 and 11, so that spray caps can be made uniformly without a dip tube, and dip tubes of assorted lengths may be added, for accommodating various sizes of liquid supply containers.

Figure 8:
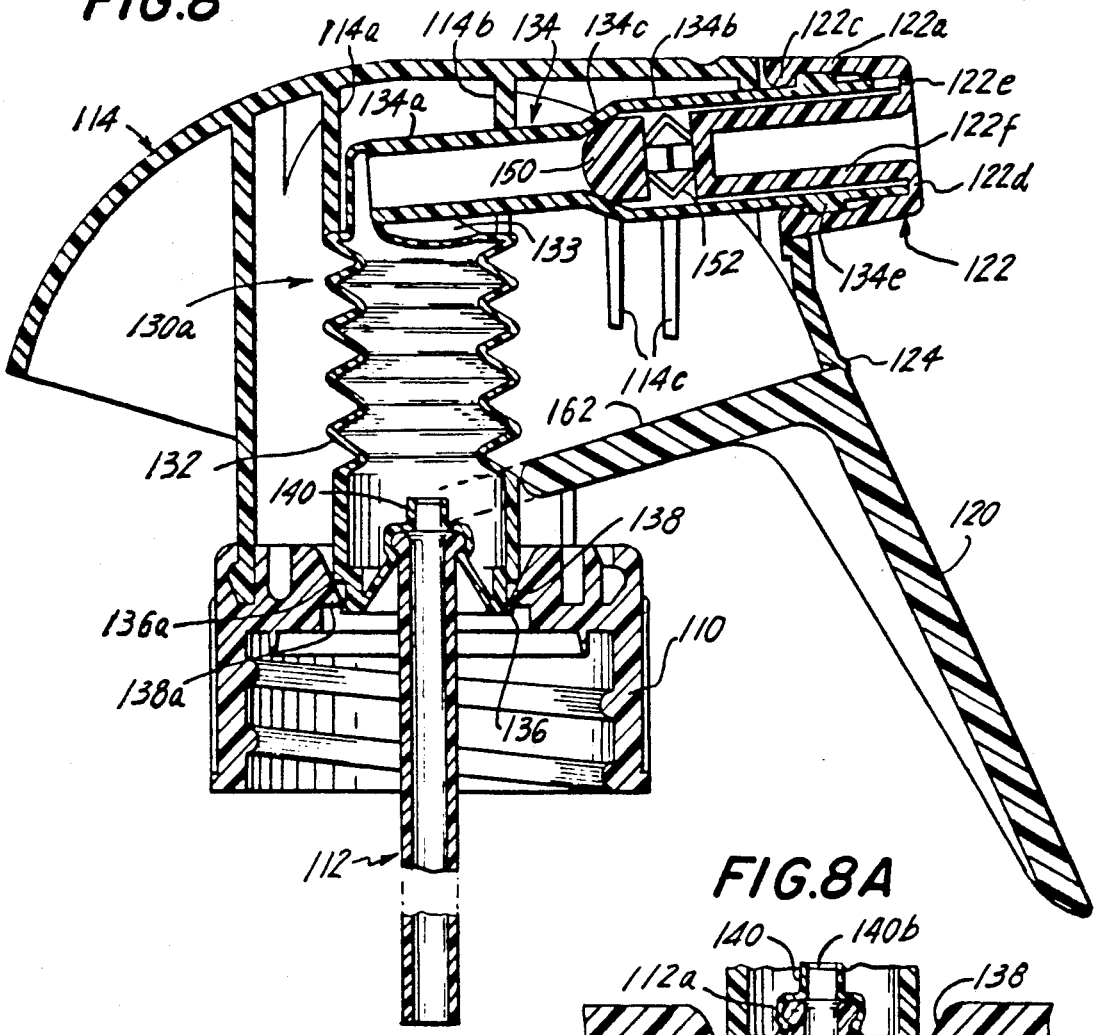
FIG. 8 is an enlarged vertical cross-section of the second spray cap embodying aspects of the invention in common with the spray cap of FIGS. 1–7, FIG. 8 embodying further aspects of the invention.

All of liquid passage means 130, other than dip tube 112, is in the form of a single component 130*a* of plastic which may be produced in the form shown in FIG. 11 by injection blow-molding. One portion of component 130*a* is a resilient self-extending bellows 132 and another portion is a basically tubular discharge-passage portion 134. These portions in their as-molded condition are coaxial as shown in FIG. 11. In common with the spray cap of FIGS. 1-7, components 130*a* of FIGS. 8 and 11 is a one-piece plastic molded component that is in one configuration as it is molded and it is bent into its final configuration. It includes a transition 133 between bellows 132 and discharge passage portion 134. The transition between these parts accommodates bending, so that (see FIG. 8) discharge passage portion 134 extends roughly perpendicular to bellows 132.

At its upper end, dip tube 112 has a projecting bead 112*a* (FIG. 12) that is tightly received in a complementary circular groove in the molded unit 130*a*. The dip tube is forcibly inserted and becomes a unified part of the passage means 130. Making the dip tube as a separate component allows production of a single spray-cap to which dip tubes of various lengths may be added for use with various sizes of supply container.

At its lower end, unit 130*a* includes full-circle sealing ridge 136*a* which, in FIG. 8, forms a seal to conical valve seat 138. The lower end of unit 130*a* also has a continuous circular rib 136 that cooperates with a continuous circular shoulder 138*a* FIG. 8) of valve seat 138 when the parts are in the condition represented in FIG. 8. In that condition, parts 136 and 136*a* cooperate with valve seat 138 to form a so-called shipping seal, preventing escape of liquid from the liquid supply container (not shown) to the exterior. Parts 136 and 138 in this condition serve additionally as a detent to lock the ridge 136 in sealing engagement with valve seat 138. The material of which rib 136 and sealing ridge 136*a* are formed is ideally a resilient and deformable plastic, consistent with the qualities of the entire unit 130*a*.

Figure 8A:
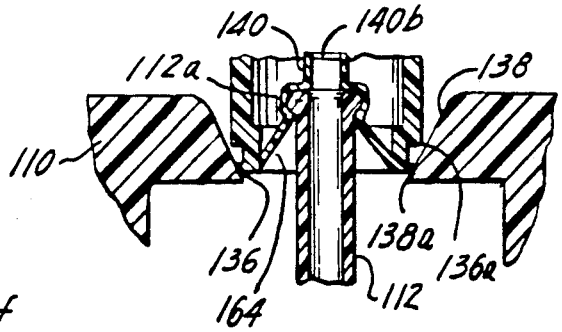
FIG. 8A is a fragmentary detail of a portion of FIG. 8 in another relationship of two of the parts.
Figure 9:
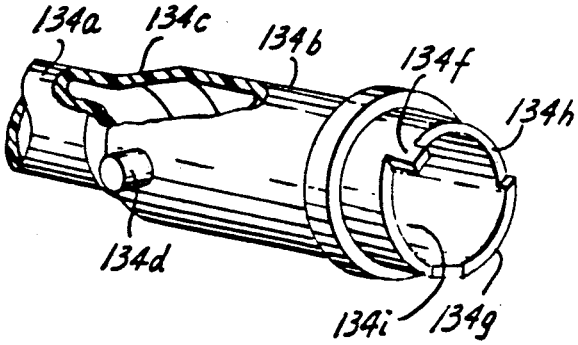
FIG. 9 is an enlarged fragmentary perspective view, partly in cross-section, of a component of the spray cap of FIG. 8.
Figure 10:
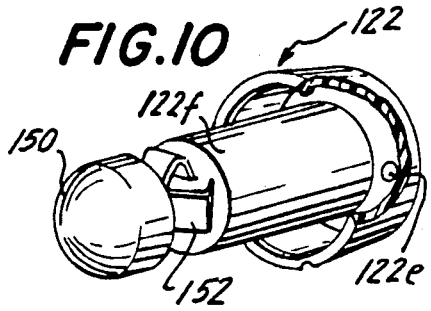
FIG. 10 is an enlarged perspective view, partly in cross-section of the nozzle of the spray cap of FIGS. 1–7.

FIG. 8A shows rib 136 serving as a valve body that seals against valve seat 138, to form a venting valve. The lower end structure of unit 130*a* is forcibly lifted to change from the shipping condition of FIG. 8 to the condition of FIG. 8A, with the spray cap ready for use. Venting valve 136, 138 is closed in FIG. 8A, preventing liquid from leaking past the valve seat. When the spray cap is being operated to dispense liquid, rib 136 is lifted away from valve seat 138; the venting valve allows air to enter the container to replace the volume of the discharged liquid, thereby to prevent a vacuum from forming in the container.

Unit 130*a* has an integral intake check valve 140 (FIGS. 8, 8A, 12 and 13). Thin and flexible roughly flat wall portions 140*a* converge upward and form a seal at the apex where they abut each other. There is no passage at this apex in the as-molded condition of component 130*a*. A blade is used to cut through the molded material at the apex, thus forming a self-closing slit 140*b*. When pressure develops within the bellows, that pressure bears against the outer surfaces of walls 141*a*, insuring the closing of slit 140*b*. When bellows 132 is becoming extended (after having been compressed), the reduced-pressure condition outside walls 140*a* draws the walls apart, opening slit 140*b* and opening the intake check valve.

Manual trigger 120 in FIG. 8 is molded as one piece with housing 114. The housing and trigger 120 are connected by the thin "living hinge" 124 which is part of the molded piece. Trigger 120 has a forked arm 162 that bears buttons 162*a*. These buttons are received in diametrically opposite cavities 166 at the lower end of unit 130*a* (only one of these cavities being shown). When trigger 120 is squeezed, the lower end of the bellows is lifted, intake check valve 140 closes, and the liquid in bellows 132 is driven into discharge passage portion 134.

When trigger 120 is released, it is restored virtually to the position shown in FIG. 8 by the self-extending resilient bellows 132. Trigger 120 allows the bellows to restore rib 136 into contact with venting valve seat 138.

Discharge passage portion 134 includes smaller and larger diameter portions 134*a* and 134*b*, with a conical transition 134*c* between them. This transition constitutes the seat of a discharge check valve. Discharge passage portion 134 has opposite external projections 134*d* (one shown in FIG. 9) that are captive housing. During assembly of the spray cap, discharge passage portion 134 is moved into the position of FIG. 8 by first being directed through opening 114*d* (FIG. 14), placing projections 134*d* between paired ribs 114*a* in the housing, and shifting the bellows 132 upward until unit 130*a* reaches the assembled condition of FIG. 8. In that condition, tube portion 134*a* is received in a matching opening in barrier 114*b* (FIGS. 8 and 14) extending across the housing 114. Nozzle 122, when assembled to the discharge passage portion 134*b*, cooperates with housing 114 so that discharge passage portion 134*b* in formation 114*b* cannot shift downward.

Nozzle 122 comprises a cup or cap having a roughly cylindrical side wall 122*a*, being externally tapered in the form shown An inside circular bead 122*c* abuts and forms a seal with an integral circular rib 134*e* on the exterior of discharge passage portion 134*b*. The end 122*d* of nozzle 122 bears against abutments 134*f* and 134*g* (FIG. 9) of passage portion 134, the nozzle being held against those abutments by the mutual cooperation of circular ribs or beads 122*c* and 134*e*. By rotating nozzle 122, an orifice 122*e* in the end of the nozzle (FIGS. 8 and 10) can be positioned at abutment 134*g* to shut off any discharge of liquid. Ledge 134*h* between abutments 134*f* and 134*g* (FIG. 9) has only a small clearance from that end 122*d* of the nozzle. Accordingly, when aperture 122*e* of the nozzle is in position opposite to ledge 134*h*, the discharge is a spray; relatively high pressure is needed to discharge only a small amount of liquid. Orifice 122*e* in rotatable nozzle 122 is then carried selectively to abutment 134*g* and ledge 134*i*, and to abutment 134*f* as well. Accordingly, the orifice is eccentric relative to the axis of the nozzle and relative to the axis of discharge portion 134*b* on which the nozzle is rotated for adjustably controlling the discharge. Finally, ledge 134*i* of discharge portion 134 has a larger clearance from the end 122*d* of the nozzle. When aperture 122*e* is turned to be opposite to ledge 134*i*, and trigger 120 is squeezed, the discharge is a jet stream.

A central post 122*f* of nozzle 122 extends inward. This post is conveniently made hollow; at its inner end, three leaf springs 152 that are integral portions of the nozzle, carry an outlet check valve body 150. Three leaf springs are used here, being bowed outward at 90° intervals, as a configuration that can be molded readily. Springs 152 bias outlet check-valve body 150 against valve seat 134*c*. When trigger 120 is squeezed and the liquid in the bellows develops substantial pressure, outlet check-valve body 150 is lifted away from its seat and liquid under pressure can flow into the nozzle. As shown in FIG. 8, there is ample separation between tube 134*b* (the end portion of unit 130*a*) and post, 122*f* of the nozzle to form a suitable passage to orifice 122*e*. Longitudinal ribs (not shown) may be included to center post 122*f* in tube 134*b*.

In common with the spray cap of FIGS. 1-7, the spray cap of FIGS. 8-14 has a straight as-molded part 130*a*. After being assembled to housing 114, component 130*a* has a roughly right-angle bend at the transition from bellows 132 to discharge passage portion 134. The bent transition is positioned by housing formations 114*a* and 114*b* so that the bellows is somewhat compressed when trigger 20 is extended and the vent valve 136, 138 is closed. Trigger 120 is in a position below nozzle 122 and passage portion 134, and the trigger is spaced to the right of the axis of dip tube 112 and bellows 132. There are transitions between the relatively large cross-section of the bellows and the much smaller cross-sections of dip tube 112 and discharge passage portion 134 of the one-piece component 130*a* which therefore has transitions at the ends of the bellows in the injection blow-molded component 130*a*. In the spray caps of FIGS. 1-7 and FIGS. 8-14, the same closure, housing and nozzle can be used to provide a range of different amounts of liquid dispensed for each stroke of the trigger by making a variety of components 130*a* with various diameters of the bellows.

The lower end of injection blow-molded component 130*a* is shown in FIG. 11. (This Figure is somewhat simplified; it omits some of the small shapes such as ridge 136 that are actually part of as-molded component 130*a*.) Conical wall 164 projects outward in its as-molded condition. When dip tube 112 is forced into place, conical wall 164 becomes reversed and assumes its in-use condition, projecting upward into the pump chamber (FIGS. 8 and 8A).

The as-molded condition of the housing component (FIG. 11) has trigger 120 projecting outward and arm 162 projecting downward, whereas trigger 120 and arm 162 have a very different relationship to housing 114 in their in-use condition (FIG. 8).

We claim:

1. A spray cap, including a closure for mounting the spray cap on a supply container, a nozzle, a manually operable pump including a pump chamber, and a discharge conduit from the pump chamber to the nozzle, a discharge check-valve seat between said pump chamber and said nozzle, a discharge check-valve body, and at least one resilient element supporting said discharge check-valve body on said nozzle and biasing said discharge check-valve body against said discharge check-valve seat, said nozzle and said biasing means and said discharge check-valve body constituting a single component of molded plastic.

2. A spray cap as in claim 1 wherein said nozzle has an end wall and a side wall extending from said end wall, said discharge conduit extending within said side wall, said nozzle having a post extending from said end wall within said side wall and to a position of clearance beyond the side wall, said resilient element being disposed in said position of clearance, said post being a portion of said single component.

3. A spray cap as in claim 1, wherein said nozzle has an end wall and a side wall extending from said end wall, said discharge conduit having a tubular end portion within said side wall and said tubular end portion terminating in multiple mutually different flow-control formations and a shut-off formation directly opposed to said end wall of the nozzle, and said nozzle having an orifice in the end wall thereof cooperable selectively with said formations.

4. A spray cap as in claim 1, wherein said nozzle has an end wall and a side wall extending from said end wall, further including a post extending within said discharge conduit from said end wall to said biasing means, said post being a portion of said single component.

5. A spray cap as in claim 4, wherein said end wall of the nozzle has an orifice therein and wherein said discharge conduit has a tubular end portion about said post and has arcuately distributed flow-control portions, said nozzle being adjustable about said tubular end portion so as to dispose said orifice in cooperation selectively with said flow-control portions.

6. A spray cap, including a closure for mounting the spray cap on a supply container, a nozzle, a manually operable pump including a pump chamber, and a discharge conduit from the pump chamber to the nozzle, said pump chamber including a lengthwise compressible self-extending bellows having intake and discharge portions at its opposite ends, said discharge conduit and said bellows being a one-piece molded plastic component, the discharge conduit being in alignment with said bellows in the as molded condition of said component and the discharge conduit extending at approximately right angles to the pump chamber in the operative condition of the spray cap.

7. A spray cap as in claim 6, said intake portion of the bellows having an intake check valve as a portion of said component, said intake check valve comprising wall portions converging in the direction of said discharge portion and meeting at an apex and said wall portions being exposed to the pressure in the pump chamber, being alternately pressed toward and away from each other as the bellows is compressed and extended in the operation of the pump, said wall portions having seal forming surfaces in mutual engagement at the apex, closing the intake check valve except when the pump chamber is being extended.

8. A spray cap as in claim 6 wherein the intake end portion of the bellows is moveable and has, as integral portions thereof, an annular shipping-seal portion and an annular vent-valve rib, and wherein said closure has, as integral portions thereof, a vent-valve seat and a detent shoulder, said vent-valve rib alternately engaging and disengaging said vent-valve seat during use of the spray cap to open and close the vent valve and said shipping seal portion engaging said vent-valve seat so as to form a shipping seal when the spray cap is in shipping condition, said annular vent-valve rib being engageable with said detent shoulder to maintain said shipping seal.

9. A spray cap including a closure for mounting the spray cap on a supply container, a nozzle, a manually operable pump including a pump chamber having stationary and movable opposite ends, a vent valve having a vent-valve seat and an annular vent-valve body, the vent valve being operable alternately to open a vent passage from the supply container to the atmosphere and to close the vent passage, a portion of said closure being the vent-valve seat and a portion of said movable end of the pump chamber being said annular and being said vent-valve body, and a shipping seal for blocking leakage via the vent valve including an annular sealing formation carried by the movable end of the pump chamber and engageable with said vent-valve seat and detent means for holding the annular sealing formation against the vent-valve seat, said detent means including a movable detent carried by the movable end portion of the pump chamber and a shoulder portion of said closure retentively engageable by said movable detent.

10. A spray cap as in claim 9 wherein said shoulder portion of the closure is a circular formation and said vent-valve body constitutes said movable detent and is sealed to said circular formation when said annular sealing formation engages said vent-valve seat.

11. A spray cap, including a closure for mounting the spray cap on a supply container, a nozzle, a manually operable pump including a pump chamber, and a discharge conduit from the pump chamber to the nozzle, said pump chamber comprising a one-piece molded component formed of resilient plastic including a lengthwise compressible self-extending bellows, said component having intake and discharge portions at the opposite ends of the bellows, and an intake check valve extending from said intake portion of said component as an integral portion thereof, said intake check valve comprising wall portions converging in the direction of said discharge portion and meeting at an apex within said pump chamber and said wall portions being exposed to pressure that develops in the pump chamber in the operation of the pump, said wall portions having seal forming surfaces in mutual engagement at the apex, closing the intake check valve.

12. A spray cap as in claim 11, wherein said apparatus includes a vent valve, a portion of said closure being formed as a vent-valve seat, said intake portion of said bellows being reciprocable and being formed as a vent-valve body cooperable with said vent-valve body when the bellows is extended so that the vent valve is closed, said apparatus including manual means for shifting said intake end of the bellows to compress the bellows and open the vent valve.

13. A spray cap, including a closure for mounting the spray cap on a supply container, a nozzle, a manually operable pump including a pump chamber, and a discharge conduit from the pump chamber to the nozzle, said nozzle having an end wall directly opposed to an end portion of said discharge conduit and a generally cylindrical side wall, said side wall and said discharge conduit having, as integral portions thereof, mutually cooperating formations extending full circle about a common axis for retaining said end wall of said nozzle against said end portion of the discharge conduit and for maintaining a seal between the nozzle and the conduit end portion in various angular adjustments of the nozzle, said nozzle being adjustable about said axis, said end portion of the discharge conduit having multiple differing flow-control formations and a shut-off formation distributed about said axis, and said end wall of said nozzle having an eccentric orifice cooperable selectively with said flow-control formations and said shut-off formation.

14. A spray cap as in claim 13 including a discharge check-valve seat between said pump chamber and said nozzle, a discharge check-valve body, and at least one resilient element supporting said discharge check-valve body on said nozzle and biasing said discharge check-valve body against said discharge check-valve seat.

15. A spray cap as in claim 14 wherein said nozzle and said biasing means and said discharge check-valve body constitute a single component of molded plastic.

16. A spray cap including a closure for mounting the spray cap on a supply container, a nozzle, a manually operable pump including a pump chamber having stationary and movable opposite ends, a vent valve having a vent-valve seat and an annular vent-valve body, the vent valve being operable alternately to open a vent passage from the supply container to the atmosphere and to close the vent passage, a portion of said closure being the vent-valve seat and a portion of said movable end of the pump chamber being said annular vent-valve body, and a shipping seal for blocking leakage via the vent valve including an annular sealing formation forming a portion of the movable end of the pump chamber and said shipping seal including a companion sealing formation engageable by said annular sealing formation, said spray cap including detent means for holding the annular sealing formation against said companion sealing formation.

17. A spray cap as in claim 16, wherein said detent means comprises mutually cooperative portions of said movable end of the pump chamber and of said closure.

* * * * *